US006344096B1

(12) United States Patent
Baumann et al.

(10) Patent No.: US 6,344,096 B1
(45) Date of Patent: Feb. 5, 2002

(54) METHOD OF PRODUCING ALUMINUM ALLOY SHEET FOR AUTOMOTIVE APPLICATIONS

(75) Inventors: Stephen F. Baumann, Penn Hills; Robert E. Sanders, Jr., New Kensington, both of PA (US); Scott L. Palmer, Ravenswood, WV (US)

(73) Assignee: Alcoa Inc., Pittsburgh, PA (US)

( * ) Notice: Subject to any disclaimer, the term of this patent is extended or adjusted under 35 U.S.C. 154(b) by 0 days.

(21) Appl. No.: 08/439,035

(22) Filed: May 11, 1995

(51) Int. Cl.[7] ..... C22F 1/04

(52) U.S. Cl. ..... 148/551; 148/552; 148/695; 148/698; 148/699; 148/700; 148/702

(58) Field of Search ..... 148/551, 552, 148/695, 698, 699, 700, 702, 437, 438, 439, 440

(56) References Cited

U.S. PATENT DOCUMENTS

| | | | | |
|---|---|---|---|---|
| 3,560,269 A | | 2/1971 | Anderson et al. | 148/439 |
| 4,111,721 A | | 9/1978 | Hitchler et al. | 148/689 |
| 4,186,034 A | | 1/1980 | Akeret | 148/550 |
| 4,238,248 A | | 12/1980 | Gyöngyös et al. | 148/551 |
| 4,334,935 A | | 6/1982 | Morris | 148/551 |
| 4,441,933 A | | 4/1984 | Boutin et al. | 148/550 |
| 4,517,034 A | | 5/1985 | Merchant et al. | 148/439 |
| 4,526,625 A | | 7/1985 | Merchant et al. | 148/551 |
| 4,753,685 A | | 6/1988 | Usui et al. | 148/551 |
| 4,808,247 A | | 2/1989 | Komatsubara et al. | 148/552 |
| 4,855,107 A | | 8/1989 | Teirlnick et al. | 420/546 |
| 4,872,921 A | | 10/1989 | Teirlinck | 148/552 |
| 4,968,356 A | | 11/1990 | Tanaka et al. | 148/552 |
| 5,104,459 A | | 4/1992 | Chen et al. | 148/552 |
| 5,104,465 A | | 4/1992 | McAuliffe et al. | 148/439 |
| 5,106,429 A | | 4/1992 | McAuliffe et al. | 148/552 |
| 5,192,378 A | | 3/1993 | Doherty et al. | 148/691 |
| 5,240,522 A | | 8/1993 | Tanaka et al. | 148/693 |
| 5,503,689 A | * | 4/1996 | Ward, et al. | 148/551 |
| 5,516,374 A | * | 5/1996 | Habu et al. | 148/552 |
| 5,562,784 A | * | 10/1996 | Nishikawa et al. | 148/552 |
| 5,582,660 A | * | 12/1996 | Erickson et al. | 148/439 |

OTHER PUBLICATIONS

Nes, et al. "Casting and Annealing Structures in Strip Cast Aluminium Alloy," Aluminium 55, pp. 319–324 (1979).

* cited by examiner

*Primary Examiner*—George Wyszomerski
(74) *Attorney, Agent, or Firm*—Arnold B. Silverman; David W. Brownlee; Edward L. Levine

(57) ABSTRACT

The present invention relates to an improved method of producing an aluminum alloy sheet which, in one embodiment, includes roll casting an aluminum alloy strip having a thickness of less than about 0.5 inch and, subsequently, preferably without intervening thermal treatments or surface cleaning, cold rolling the strip to a thickness of less than about 0.15 inch, after which the cold rolled strip is subjected to thermal treatment which is preferably either continuous annealing or solution heat treatment. The aluminum alloy, in a continuous annealing embodiment, is preferably selected from the group consisting of the 3XXX and 5XXX series. In another embodiment wherein solution heat treatment is employed, the aluminum alloy is preferably selected from the group consisting of 2XXX and 6XXX. The sheet may be converted into a motor vehicle body panel.

16 Claims, No Drawings

METHOD OF PRODUCING ALUMINUM ALLOY SHEET FOR AUTOMOTIVE APPLICATIONS

BACKGROUND OF THE INVENTION

1. Field of the Invention

This invention relates to an improved method of producing aluminum alloy sheet products by twin roll casting and processing the sheet to a final automotive body sheet. More specifically, it relates to such a method which produces sheet having improved formability and strength.

2. Description of the Prior Art

With the increased emphasis on the desirability of reducing the weight of motorized vehicles, such as automobiles, vans, trucks and sport utility vehicles, there has been increased motivation to replace steel body panels of vehicles with lighter aluminum panels. In order to make such a transformation appealing, the strength and formability of the aluminum sheet alloys must be comparable to that of steel sheet and must be economically competitive. Typically in the prior art practices, aluminum would be cast into an ingot of approximately 12 to 28 inches in thickness, which ingot would be scalped and preheated, after which it might be hot rolled to about 0.125 inch, cold rolled to about 0.020 to 0.060 inch, and subjected to further heat treatment, such as batch annealing or solution heat treatment. One of the problems with such an approach has been the size of the intermetallic particles present in the as-cast aluminum ingots which is a characteristic of the alloy composition and solidification rate in the casting process. These particles can participate in the fracture initiation and propagation process and, as a result, limit formability or design tolerance properties. The intermetallic particles act as void nucleation sites during sheet forming processes, such as stretching and, therefore, contribute to fracture initiation.

The twin roll casting process produces aluminum sheet containing smaller intermetallic particles than the ingot route, as a result of the higher solidification rate. The process produces heavy sheet thicknesses which may be on the order of about 0.200 to 0.350 inch. See Nes et al., "Casting and Annealing Structures in Strip Cast Aluminum Alloy," Aluminium 55, (5), pp. 319–324 (1979). Aluminum sheet cast by this method is cast at a relatively slow speed which may be on the order of 50 to 80 inches per minute, thereby resulting in relatively low productivity. This low productivity offsets most of the cost savings that would otherwise be achieved by employing twin roll casting processes. Conventional post-caster processing usually includes one or more batch-type anneal or homogenization steps in which the cooling rate following these thermal treatments is extremely slow and may be on the order of about 50° F. per hour. This slow cooling rate permits significant precipitation of phases containing soluble alloy elements, such as magnesium and copper, which if left in the solid solution in the aluminum matrix, would increase the strength and might contribute to enhanced formability of the finished product.

U.S. Pat. No. 4,441,933 discloses the production of aluminum sheets suitable for drawing wherein the roll cast product is subjected to mechanical brushing or subjected to a jet of gas in a cleaning treatment, after which it is subjected to batch annealing or continuous annealing.

U.S. Pat. No. 4,186,034 discloses casting an aluminum magnesium alloy having a zinc addition in order to render the alloy deformable in the soft condition and suitable for motor vehicle body components. The process includes hot rolling the ingot followed by cold rolling, annealing, further cold rolling, and cooling. See, also, U.S. Pat. No. 4,753,685.

U.S. Pat. No. 4,808,247 discloses an aluminum-silicon-magnesium-copper alloy for use in automotive body components to provide the desired strength and formability.

In spite of the foregoing disclosures, there remains a substantial need for an effective process of producing aluminum alloy sheet for automotive applications in a more economical manner while having the desired formability and strength characteristics.

SUMMARY OF THE INVENTION

The present invention has met the hereinabove described needs. In a preferred practice of the present invention, an aluminum alloy strip is created by roll casting and has a thickness of less than about 0.5 inch and, preferably, less than about 0.20 and, most preferably, about 0.040 inch to 0.20 inch. The roll cast strip could then be cold rolled to the final sheet thickness for the specific application which will generally be less than about 0.15 inch and preferably about 0.020 to 0.15 inch and, must preferably, about 0.020 to 0.040 inch. The cold rolled sheet then is subjected to continuous annealing, preferably at a temperature above 750° F., but below the melting temperature of the alloy for about 1 to 60 seconds. A preferred use of the panels produced in accordance with this embodiment of the invention is in the formation of internal body structural panels for motor vehicles.

In another embodiment of the invention, in lieu of the continuous annealing, one may subject the cold rolled sheet to solution heat treatment at a temperature above the solvus temperature, but below the melting temperature of the alloy at a temperature of about 800° F. to 1100° F. for about 1 to 60 seconds and, preferably, about 2 to 30 seconds. Such panels exhibit high strength and are particularly suited for use in body panels.

The method preferably does not employ thermal treatment between casting and cold rolling.

Among the alloys suitable for use in the continuous annealing embodiment of the invention are alloys of the AA 3XXX and 5XXX series. Among the alloys suitable for use in the solution heat treatment embodiment of the invention are the AA 2XXX and 6XXX series.

It is an object of the present invention to provide a process for producing aluminum alloy sheet having equal or improved combinations of strength and formability at lower manufacturing cost.

It is another object of the present invention to produce such strip which has desired surface quality and may be created while eliminating certain prior art thermal treatment steps in order to minimize the cost of the sheet manufacturing process.

It is another object of the present invention to provide a method of producing aluminum motor vehicle body sheet.

It is a further object of the present invention to produce aluminum alloy sheet which is uniquely suited in respect of strength, formability and surface properties for use in motor vehicle body panels.

These and other objects of the invention will be more fully understood from the following detailed description of the invention.

DESCRIPTION OF THE PREFERRED EMBODIMENTS

As employed herein, the term "motor vehicle" shall include automobiles, vans, trucks, and sport utility vehicles.

While for simplicity of disclosure herein, specific reference will be made to motor vehicle body panels, it will be appreciated that the process of the present invention may be employed advantageously to create sheet suitable for numerous other uses. For example, for motor vehicle outer body panels, dent resistance is an important characteristic which depends on yield strength of the panel. Also, it is desirable to have the body panel sheet harden during the thermal treatment designed to cure the paint. For body panels, high formability is also a desired property. For motor vehicle structural sheet, the sheet should have desired stiffness, formability and weldability. TABLE I illustrates currently preferred ranges, respectively, for the outer body panels and body structural sheet.

TABLE I

| | Yield Strength* (ksi) | Elongation** (Percent) |
|---|---|---|
| Outer Body Panel | 25–30 | 20–30 |
| Body Structural Sheet | 12–18 | 20–30 |

*After paint bake
**In temper being formed

It will be appreciated from the data which follows that the sheet produced by the present invention satisfies these standards.

In a preferred practice of the invention, for producing an aluminum alloy sheet having high strength and formability with desired surface quality, an aluminum strip is twin roll cast to a thickness of less than about 0.5 inch, preferably less than about 0.20 inch and, most preferably about 0.040 to 0.20 inch, after which, if desired, it is subjected to cold rolling to produce a sheet having a final thickness of about 0.020 to 0.15 inch and, preferably, about 0.020 to 0.040 inch. Subsequently, the cold rolled sheet is subjected to continuous annealing at a temperature of between 750° F. and the melting temperature of the alloy for about 2 to 30 seconds. In a preferred practice of the invention, the roll cast strip will have a thickness of about 0.040 to 0.20 inch, and the strip will be reduced by cold rolling to a sheet having a thickness of about 0.020 to 0.040 inch. In the preferred practice of the invention, the cold rolling is effected without intermediate thermal treatment, hot rolling, or surface cleaning between the roll casting and cold rolling. There is no required hot rolling step employed prior to the cold rolling. Some hot worked structure may be present in the strip as a result of the roll casting process. The continuous annealing is effected in order to reduce the yield strength and render the material more formable. The continuous annealing may be effected at about 750° F. to the aluminum alloy melting temperature for about 1 to 60 seconds and, preferably, about 800° F. to 950° F. for 2 to 15 seconds. The sheet is then preferably cooled to protect the surface.

This approach of the present invention is to be contrasted with the conventional approach of casting an ingot of about 12 to 28 inches in thickness followed by scalping, preheating, homogenizing, hot rolling to approximately 0.125 inch, after which cold rolling and annealing may be employed.

Among the alloys which may be employed in the continuous anneal process of the present invention are alloys of the 3XXX series and 5XXX series. Examples of specific suitable alloys are 5042, 5052 and 5182, for example.

After employing this process, conventional means may be employed to convert the aluminum alloy sheet into the desired motor vehicle panel.

In a related embodiment of the invention, after casting in the manner hereinbefore described, cold rolling may be effected to about 0.020 to 0.15 inch and, preferably, about 0.020 to 0.080 inch, followed by solution heat treatment rather than continuous annealing. The solution heat treatment may be effected at a temperature of about 800° F. to 1100° F. for about 1 to 60 seconds and, preferably, about 950° F. to 1050° F. for about 2 to 15 seconds in order to cause one or more of the alloying constituents to enter solid solution. This is followed by sufficiently rapid cooling as to resist undesired constituent precipitation. Such cooling may be effected, for example, by forced air, water spray or water mist.

Among the alloys suitable for use in the heat treatment embodiment of the invention are alloys of the 2XXX series and 6XXX series. Examples of suitable alloys for use in the solution heat treatment embodiment of the invention are 2008, 2036, 6009 and 6111.

In order to provide additional details regarding the invention, several examples will be provided.

EXAMPLE 1

This example employed a heat treatable alloy which was a manganese-free version of AA6009. The alloy had the weight percent composition 0.71 Si, 0.20 Fe, 0.30 Cu, and 0.77 Mg, with the balance being aluminum and impurities.

The sheet was roll cast to a thickness of 0.220 inch, cold rolled to 0.040 inch, followed by solution heat treating for 30 seconds at 1040° F. The sheet was then naturally aged for 4 weeks to a –T4 temper.

TABLE II shows a comparison of (1) sheet produced by the present invention in accordance with this example, as compared with (2) sheet produced by conventional prior art ingot forming techniques.

TABLE II

| | Material | Test Direction | Ultimate Tensile Strength (ksi) | Yield Strength (ksi) | Elongation % |
|---|---|---|---|---|---|
| 1. | Process of This Example | Transverse | 39.7 | 21.8 | 24.2 |
| | | Longitudinal | 40.7 | 23.0 | 23.5 |
| 2. | Prior Art Nominal Ingot Route | Transverse | 37.7 | 21.6 | 23.8 |

It will be appreciated that in ultimate tensile strength, yield strength, and elongation of the sheet produced by the simplified, economical process of the present invention created sheet of superior or equal properties to the prior art method.

Additional formability tests were run comparing (1) sheet produced by the present invention, produced within this example, with (2) that produced by the prior art ingot route. The results are shown in TABLE III.

TABLE III

| | Material | Limiting Dome Height/Inches | Guided Bend (Radius/Thick) Longitudinal | Guided Bend (Radius/Thick) Transverse | Longitudinal Stretch Bend (Height/Thickness) |
|---|---|---|---|---|---|
| 1. | Process of This Example | 0.923 | 0.532 | 0.532 | 34.08 |

TABLE III-continued

| | Material | Limiting Dome Height/Inches | Guided Bend (Radius/Thick) Longitudinal | Guided Bend (Radius/Thick) Transverse | Longitudinal Stretch Bend (Height/ Thickness) |
|---|---|---|---|---|---|
| 2. | Prior Art Nominal Ingot Route | 0.912 | 0.65 | 0.71 | 29.48 |

The results of TABLE III show that the strength level of the sheet produced by the present invention, produced in accordance with this example, is generally equal to that of the prior art ingot route sheet with the sheet of the present invention having superior formability with respect to the prior art ingot route sheet.

A comparison was made between (1) the sheet of the present invention, produced in accordance with this example, and (2) the prior art ingot route after both were subjected to a forming operation following a paint bake in order to simulate conversion of the sheet into a motor vehicle outer body panel. The forming operations involved stretching 2% to simulate forming strain and a baking cycle of 30 minutes at 350° F. The results are shown in TABLE IV.

TABLE IV

| | Material | Ultimate Tensile Strength (ksi) | Yield Strength (ksi) |
|---|---|---|---|
| 1. | Process of This Example | 40.8 | 25.0 |
| 2. | Prior Art Nominal Ingot Route | 39.8 | 26.3 |

Both materials exhibited good properties with the sheet of the present invention being produced by the simplified, economical process of the present invention.

EXAMPLE 2

The tests of Example 1 were repeated with some modifications with a non-heat treatable alloy, AA5052. The alloy had the weight percent composition 0.15 Si, 0.37 Fe, 2.37 Mg and 0.20 Cr. The sheet was roll cast to 0.197 inch and, subsequently, cold rolled to 0.040 inch, followed by continuous annealing for 30 seconds at 800° F. A fully annealed –0 temper resulted.

TABLES V through VII show that the (1) sheet of the present invention, as produced by this example, had comparable, good properties as compared with the (2) sheet produced by the prior art ingot route.

TABLE V

| | Material | Test Direction | Ultimate Tensile Strength (ksi) | Yield Strength (ksi) | Elongation % |
|---|---|---|---|---|---|
| 1. | Process of This Example | Longitudinal | 31.0 | 14.8 | 22.1 |
| | | Transverse | 30.8 | 15.0 | 20.1 |
| 2. | Prior Art Nominal Ingot Route | Longitudinal | 30.4 | 13.8 | 22.0 |
| | | Transverse | 28.5 | 13.6 | 27.0 |

TABLE VI

| | Material | Test Condition | Olsen Ball Height (Inch) | Limiting Dome Height (Inch) | Guided Bend (R/t) |
|---|---|---|---|---|---|
| 1. | Process of This Example | Lubricated | 0.370 | Longitudinal 0.930 | 0.42 |
| | | Dry | 0.301 | Transverse 0.928 | 0.63 |
| 2. | Prior Art Nominal Ingot Route | Lubricated | 0.396 | | |
| | | Dry | 0.300 | | |

TABLE VII

| | Material | Ultimate Tensile Strength (ksi) | Yield Strength (ksi) |
|---|---|---|---|
| 1. | Process of This Example | 31.7 | 18.6 |
| 2. | Prior Art Nominal Ingot Route | 31.6 | 15.4 |

These examples, therefore, show that the simplified, economical process of producing sheet of the present invention produces sheet with properties superior or equal to properties produced by the prior art ingot route, which route has been described hereinbefore and is well known to those skilled in the art.

It will be appreciated, therefore, that the present invention has provided an economical and effective means of producing aluminum sheet having desired strength, formability, and desired surface characteristic. All of this is accomplished in a manner which enhances speed of production by eliminating a number of prior art thermal and cleaning processes between the as-cast product and the cold rolling stage. This is in part facilitated by the casting of a relatively thin strip, the thermal treatment employed after cold rolling and the selection and use of certain preferred alloys. The invention is particularly useful in creating sheet usable in motor vehicle body panels, including those which are structural or load bearing panels as well as those which are not generally anticipated to bear substantial loads.

Whereas particular embodiments of the invention have been described herein for purposes of illustration, it will be evident to those skilled in the art that numerous variations of the details may be made without departing from the invention as set forth in the appended claims.

We claim:

1. A method of producing a motor vehicle body panel from aluminum alloy sheet comprising, roll casting an aluminum alloy strip having a thickness of less than about 0.5 inch, cold rolling said strip to a thickness of less than about 0.15 inch, effecting said cold rolling of said cast strip without prior thermal treatment of said roll cast strip, subjecting said cold rolled strip to continuous annealing at a temperature of about 750° F. to 1000° F. for about 1 to 60 seconds, subsequent to said continuous annealing converting said strip into a motor vehicle body panel, and said aluminum alloy being an alloy selected from the group consisting of 3XXX and 5XXX.

2. The method of claim 1 including said roll casting creating a strip having a thickness of less than about 0.20 inch.

3. The method of claim 2 including said cold rolling reducing said strip thickness to about 0.020 to 0.15 inch.

4. The method of claim 3 including effecting said cold rolling of said cast strip without prior hot rolling of said cast strip.

5. The method of claim 3 including subsequent to said continuous annealing converting said aluminum alloy sheet into a motor vehicle outer body panel.

6. The method of claim 1 including effecting said continuous annealing at a temperature of about 800° F. to 950° F. for about 2 to 15 seconds.

7. The method of claim 6 including effecting said cold rolling to create a strip thickness of about 0.020 to 0.040 inch.

8. The method of claim 1 including effecting said roll casting to produce a strip of about 0.040 to 0.20 inch thick.

9. The method of claim 1 including employing as said aluminum alloy an alloy selected from the group consisting of 5052, 5042 and 5182.

10. A method of producing a motor vehicle body panel from aluminum alloy sheet comprising, roll casting an aluminum alloy strip having a thickness of less than about 0.5 inch, cold rolling said strip to a thickness of less than about 0. 15 inch, effecting said cold rolling of said roll strip without prior thermal treatment of said cast strip.

subjecting said cold rolled strip to solution heat treatment at a temperature of about 800° F. to 1100° F. for about 1 to 60 seconds, subsequent to said solution heat treatment converting said strip into a motor vehicle body panel, and said aluminum alloy being an alloy selected from the group consisting of 2XXX and 6XXX.

11. The method of claim 10 including said roll casting creating a strip having a thickness of about 0.040 to 0.20 inch.

12. The method of claim 11 including said cold rolling reducing said strip thickness to about 0.020 to 0.080 inch.

13. The method of claim 10 including effecting said cold rolling of said cast strip without prior hot rolling of said cast strip.

14. The method of claim 10 including effecting said solution heat treatment at about 950° F. to 1050° F. for about 2 to 15 seconds.

15. The method of claim 10 including employing as said aluminum alloy an alloy selected from the group consisting of 2008, 2036, 6009 and 6111.

16. The method of claim 10 including subsequent to said solution heat treatment converting said aluminum alloy sheet into a motor vehicle outer body panel.

* * * * *